US006523991B1

(12) United States Patent
Maklad

(10) Patent No.: US 6,523,991 B1
(45) Date of Patent: Feb. 25, 2003

(54) METHOD AND DEVICE FOR INCREASING THE PRESSURE OR ENTHALPY OF A FLUID FLOWING AT SUPERSONIC SPEED

(76) Inventor: Jaber Maklad, Andergasse 54, 1170 Wien (AT)

( * ) Notice: Subject to any disclaimer, the term of this patent is extended or adjusted under 35 U.S.C. 154(b) by 0 days.

(21) Appl. No.: 09/508,218

(22) PCT Filed: Jul. 7, 1999

(86) PCT No.: PCT/AT99/00173

§ 371 (c)(1),
(2), (4) Date: Aug. 10, 2000

(87) PCT Pub. No.: WO00/02653

PCT Pub. Date: Jan. 20, 2000

(30) Foreign Application Priority Data

Jul. 8, 1998 (AT) ..... 1186/98

(51) Int. Cl.[7] ..... B01F 5/04
(52) U.S. Cl. ..... 366/163.2; 137/889; 137/890
(58) Field of Search ..... 366/163.1, 163.2, 366/167.1, 173.1, 174.1; 137/888–890, 896; 48/189.4

(56) References Cited

U.S. PATENT DOCUMENTS 1,195,915 A * 8/1916 Damrow
3,799,195 A * 3/1974 Hermans
4,030,969 A * 6/1977 Asplund et al.
4,210,166 A * 7/1980 Munie
5,061,406 A * 10/1991 Cheng
5,171,090 A * 12/1992 Wiemers
5,338,113 A 8/1994 Fissenko
5,857,773 A * 1/1999 Tammelin ..... 366/163.2

FOREIGN PATENT DOCUMENTS

| | | | |
|---|---|---|---|
| EP | 0 150 171 A | 7/1985 | |
| EP | 0 475 284 A | 3/1992 | |
| EP | 0 555 498 A | 8/1993 | |
| GB | 802691 | * 10/1958 | |
| SU | 1308370 | * 5/1987 | ..... 366/163.2 |
| WO | WO 93 16791 A | 9/1993 | |

OTHER PUBLICATIONS

"Gasdynamik" (*Gas Dynamics*), Dr. Klaus Ostwatitsch, Vienna, Springer press 1952, p. 440.
L.D. Landau and E.M. Lifschitz: Hydrodynamik (*Hydrodynamics*) Academy–Verlag, Berlin 1966.

* cited by examiner

*Primary Examiner*—Charles E. Cooley
(74) *Attorney, Agent, or Firm*—Henry M. Feiereisen; Ursula B. Day

(57) ABSTRACT

A method and apparatus for increasing the pressure or rise of the enthalpy of a fluid flowing at supersonic, includes mixing vapor with liquid, and accelerating this mixture to supersonic speed, whereupon a condensation shock is triggered and wherein additional liquid is introduced into the mixture, flowing at supersonic speed, before triggering of the condensation shock.

13 Claims, 2 Drawing Sheets

METHOD AND DEVICE FOR INCREASING THE PRESSURE OR ENTHALPY OF A FLUID FLOWING AT SUPERSONIC SPEED

BACKGROUND OF THE INVENTION

The present invention relates to a method of increasing the pressure or raising the enthalpy of a fluid flowing at supersonic speed, wherein vapor is mixed with liquid, and this mixture is accelerated to supersonic speed after which a condensation shock is triggered.

First, the fundamental problem of flowing mixtures of two-phase mixtures, for example air/water or vapor liquid, or the like, should be addressed.

In such mixtures, the "sonic speed" may have small values, whereby "sonic speed" is understood as the value that is decisive for the formation of the Mach number (See VDI-Zeitung (*VDI-Journal*) 99, 1957, No. 30, 21. October, "Überschallströmungen von Hoher Machzahl bei kleinen Str ömungsgeschwindigkeiten" (*Supersonic Flows of High Mach Number at Low Flow Speeds*) by Carl Pfleiderer, pp. 1535 and 1536; and "Grundlagen Für Pumpen" (*Basics for Pumps*) by em. Prof. Dipl.lng. W. Pohlentz, VEB Publishers Technik, Berlin 1975, pp. 49 and 41).

Likewise, Ostwatitsch points out, that in frothing flows at "supersonic speed" all phenomena occur as known from single-phase supersonic flow (see "Gasdynamik" (*Gas Dynamics*), Dr. Klaus Ostwatitsch, Vienna, Springer press 1952, page 440). The analogy between two-phase flow and single-phase flow of a compressible fluid is total. Thus, a convergent-divergent nozzle (Laval nozzle) is thus also needed for acceleration of a two-phase flow from "subsonic speed" to "supersonic speed", and the opposite process is possible only by means of a compression shock, or a series of compression shocks. The processes in the compression shock in the two-phase flow are likewise exceedingly complex, whereby it is surprising that the relationship between shock entry speed and shock exit speed as well as the rise in pressure is established by the flow of heat. (See "Technische Fluidmechanik" (*Technical Fluid Mechanics*) by Herbert Sieglach, VDI publishers 1982, pp. 214–230, and W. Albring, "Angewandte Stömungslehre" (*Applied Flow Instructions*), $4^{th}$ Edition, publishers Theodor Steinkopff, Dresden, 1970, pp. 183–194). The shock intensity is determined by the size of heat quantity which flows in the shock from subsonic to supersonic.

Furthermore, compressible two-phase flows behave such that the state variables—with the exception of the entropy, the temperature and the rest temperature—change in opposite direction in the subsonic and supersonic range. (See E. Truckenbrodt, "Fluidmechanik" (*Fluid Mechanics*), Volume 2, Springer Verlag 1980, page 68). For example, supply of heat to a supersonic flow means a delay, whereas supply of heat to a subsonic flow means an acceleration.

The strength of the so-called condensation shock is dependent on the amount of condensing water vapor (see Dr. Klaus Oswatitsch: Gasdynamik, Springer Verlag 1952, page 57).

The condensation shock is generated during flow of a fluid which contains oversaturated water vapor and is the result of a sudden condensation of the vapor which occurs very rapidly and within a narrow zone, designated "condensation shock area". The stability of the condensation shock in relation to small perturbances in the direction vertical to its area, depends on the thermodynamic condition of the vapor prior to the shock which should just about coincide with the start of the rapid condensation of the vapor. A detailed derivation of this process is found in L. D. Landau and E. M. Lifschitz: Hydrodynamik (*Hydrodynamics*) Academy-Verlag, Berlin 1966.

The mechanism of pressure rise is grounded in the fact that condensation of the vapor generates vacuum spaces which suddenly fill up with incoming fluid at sonic speed. The thus resultant kinetic energy is then transformed into pressure.

The extent of the pressure increase as a result of condensation is dependent on the temperature difference between the vapor and the fluid, or on the fluid temperature during mixture with vapor and on the location of the compression shock.

In tests conducted with water and water vapor, a pressure was registered, after complete condensation, via the compression shock, which pressure is sufficiently great to utilize the apparatus as a feed pump.

According to a conventional design of the above-mentioned type, known, for example, from EP 0 555 498 A1, liquid is withdrawn prior to the placement of the condensation shock in order to assure that the condensation shock takes place in the designated range. Furthermore, it is realized in the known design that the liquid, continuing to flow in the diffuser, is not excessively heated.

SUMMARY OF THE INVENTION

In accordance with the subject matter of the invention, additional liquid is introduced, before the condensation shock is triggered, in the mixture which flows at supersonic speed. As a result, the pressure in the condensation shock further increases since the higher liquid content contains a higher flow energy in the vapor/liquid mixture.

Advantageously, the supply of the additional liquid can be effected through the underpressure generated by the flowing mixture, thereby rendering the need for additional means for conveying the added liquid unnecessary.

An advantageous apparatus for carrying out the process according to the invention, includes a vapor acceleration nozzle, a feed slot for a liquid medium, a converging mixing nozzle, and a diffuser, with a parallel flow section being provided between the mixing nozzle and the diffuser and including a slot which divides the parallel flow section and has a length which, measured in the direction of the flow, is about 0.5 to 0.9 times the diameter of the parallel flow section. Through this slot size, a sufficient amount of additional fluid can be drawn in automatically, without impairing the flow of the vapor/liquid mixture.

BRIEF DESCRIPTION OF THE DRAWING

An exemplified embodiment of the apparatus according to the invention is illustrated in the drawing, in which.

DETAILED DESCRIPTION OF PREFERRED EMBODIMENTS

Figure 1:
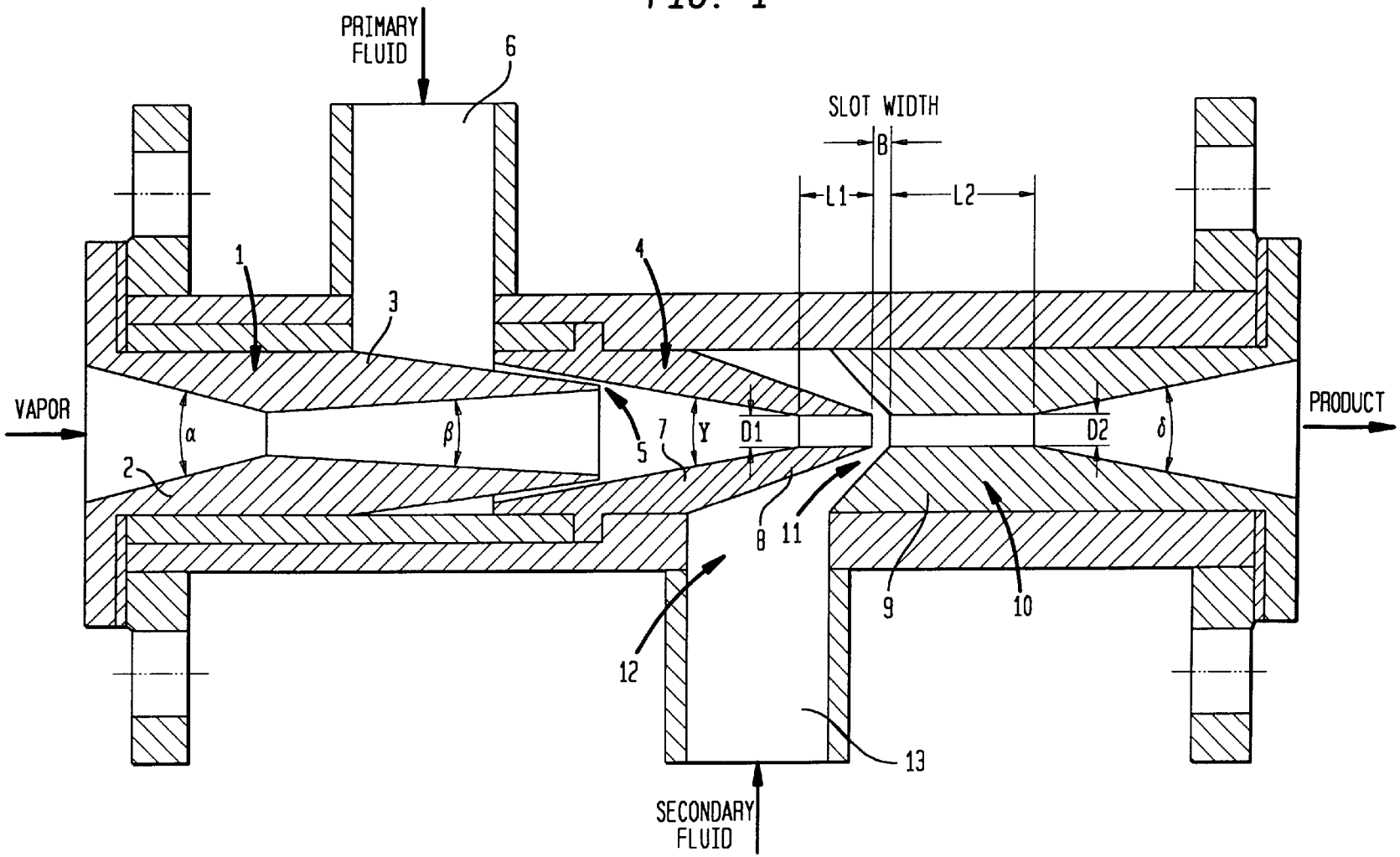
FIG. 1 shows a schematic configuration of the apparatus according to the invention.

Reference numeral 1 designates a Laval nozzle which includes a convergent part 2 having an opening angle $\alpha$ of approximately 25–60°, and a divergent part 3 having an opening angle $\beta$ of about 3–20°. A mixing nozzle 4 of convergent and cylindrical sections is provided downstream of the Laval nozzle 1, with the convergent section y having an angle of approximately 15 to 30°. The length L1 of the cylindrical section is approximately 1 to 3 times of its diameter. The divergent part of Laval nozzle 1 projects into this convergent section, with a slot 5 being left open between the end of the Laval nozzle and the inner wall of the mixing nozzle, for supply of liquid via conduit 6 and mixture with the vapor. Following the convergent part 7 of the mixing nozzle 4 is, as stated above, a parallel flow part 8 which is trailed by a parallel flow part 9 of a diffuser 10. The length L2 of the parallel flow part 9 is approximately 1 to 5 times of its inner diameter D2. The opening angle of the divergent zones of the diffuser 10 is approximately 15–45°.

Formed between the parallel flow part 8 of the mixing nozzle 4 and the parallel flow part 9 of the diffuser 10, with all of these components arranged coaxially in sequential relation, is a slot 11 having a slot width B corresponding to approximately 0.5 times of the diameter D1 of the parallel flow part 8 of the mixing nozzle 4.

The slot 11 is connected with an annular space 12 via which secondary liquid is introduced via a conduit 13 into the flowing vapor/fluid mixture.

The process executes the following steps:

1. Production of a vapor liquid mixture which travels at supersonic speed,
2. Generation of a counterpressure through triggering of a compression shock and complete condensation of the vapor fraction of the mixture, whereby the pressure increases suddenly,
3. Injection of a secondary liquid of low enthalpy into the condensation zone before the compression shock, so as to accelerate the condensation process and to thereby further increase the pressure.

These steps are carried out with the apparatus according to the invention in such a way that the vapor is conducted through the Laval nozzle, the mixing nozzle and the diffuser. Vapor is thereby accelerated in the Laval nozzle to supersonic speed whereby in the supersonic portion of the nozzle, the vapor is relieved to a pressure which is smaller than the atmospheric pressure. Liquid which is aspirated across the outer wall of the Laval nozzle into the mixing nozzle, mixes with the vapor, thereby producing a homogenous mixture of vapor and liquid, having a sonic speed which is much smaller than that of pure fluid or pure vapor (See "Führer durch die Strömungslehre" (*Guide to Fluid Dynamics*), 8th ed., Friedrich Viehweg & Sohn 1984, pp. 390–395). The mixture remains at supersonic level, despite the braking action effected by the aspiration of the liquid. As a result of the accelerated flow, a pressure, which is below atmospheric pressure, is generated in the slot between the mixing nozzle and the diffuser. A counterpressure is generated at the outlet of the diffuser via a throttle valve (not shown), which counterpressure is gradually increased until a vertical compression shock is produced in the parallel flow part 9 of the diffuser in which vapor completely condenses via the compression shock. This leads to the desired pressure increase in the flow.

Prior to the compression shock, a secondary flow of liquid is introduced into the condensation zone via the slot 11 between the mixing nozzle and the diffuser, to thereby further accelerate the condensation process and increase the pressure. With the compression shock, the condensation process is entirely completed. The condensation of the vapor is coupled with heat energy, releasing approximately 600 cal/g. The heat is absorbed by liquid exiting the diffuser.

The order of magnitude of the pressure increase as a consequence of additionally supplied liquid is shown by way of an example in table 1.

TABLE 1

| Input Data | | | | | | | | Output Data | |
|---|---|---|---|---|---|---|---|---|---|
| Vapor | | | Primary Flow Water | | | Secondary Flow Water | | | |
| Pressure [bar] | Temp. [° C.] | Amount of Flow-through [kg/h] | Pressure [bar] | Temp. [° C.] | Amount of Flow-through [l/h] | Temp. [° C.] | Amount of Flow-through $m_{sec}/m_{prim}$ [%] | Pressure [bar] | Temp. [° C.] |
| 7 | 165 | 265 | 5 | 18 | 3.000 | 18 | 0 | 17 | 70 |
| 7 | 165 | 265 | 5 | 18 | 3.000 | 18 | 8 | 18.5 | 66.5 |
| 7 | 165 | 265 | 5 | 18 | 3.000 | 18 | 10 | 19 | 65.5 |
| 7 | 165 | 265 | 5 | 18 | 3.000 | 18 | 12 | 20 | 65 |
| 7 | 165 | 265 | 5 | 18 | 3.000 | 18 | 14 | 20.5 | 64 |
| 7 | 165 | 265 | 5 | 18 | 3.000 | 18 | 16 | 21 | 63 |
| 7.5 | 167 | 282 | 5 | 18 | 3.000 | 18 | 0 | 18 | 73 |
| 7.5 | 167 | 282 | 5 | 18 | 3.000 | 18 | 8 | 19 | 69 |
| 7.5 | 167 | 282 | 5 | 18 | 3.000 | 18 | 10 | 20 | 68 |
| 7.5 | 167 | 282 | 5 | 18 | 3.000 | 18 | 12 | 21 | 67.5 |
| 7.5 | 167 | 282 | 5 | 18 | 3.000 | 18 | 14 | 22 | 66.5 |
| 7.5 | 167 | 282 | 5 | 18 | 3.000 | 18 | 16 | 22.5 | 66 |
| 7.5 | 167 | 282 | 5 | 18 | 3.000 | 18 | 18 | 23 | 65 |
| 8 | 170 | 287 | 5 | 18 | 3.000 | 18 | 0 | 19 | 74 |
| 8 | 170 | 287 | 5 | 18 | 3.000 | 18 | 8 | 21.5 | 70 |
| 8 | 170 | 287 | 5 | 18 | 3.000 | 18 | 10 | 22 | 69 |
| 8 | 170 | 287 | 5 | 18 | 3.000 | 18 | 12 | 23 | 68.5 |
| 8 | 170 | 287 | 5 | 18 | 3.000 | 18 | 14 | 24 | 67.5 |
| 8 | 170 | 287 | 5 | 18 | 3.000 | 18 | 16 | 24.5 | 67 |
| 8 | 170 | 287 | 5 | 18 | 3.000 | 18 | 18 | 25 | 66 |

These values were measured in tests with water and vapor in the Simmering power plant.

Figure 2:
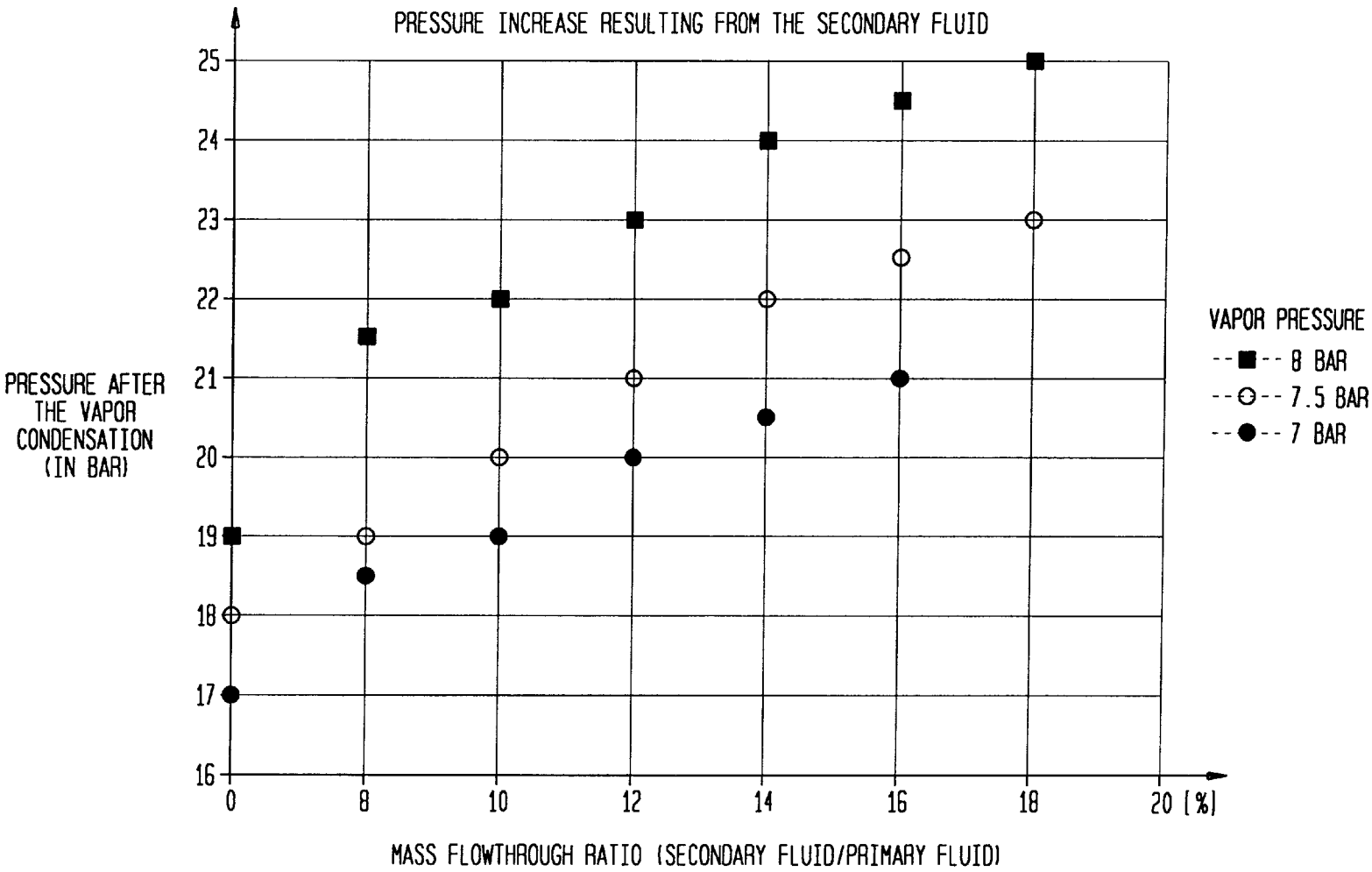
FIG. 2 is a diagram, showing graphic representations of measured results attained with the apparatus involved here.

Data from table 1 are graphically represented in the diagram as shown in FIG. 2. This diagram clearly shows the increase in pressure resulting from the added secondary liquid. At application of 7 bar, 7.5 bar or 8 bar of vapor pressure, the pressure in the flowing liquid rises from 17 bar up to 21 bar at addition of 16% of secondary fluid, from 18 to 23 bar at addition of 18% of secondary fluid, and from 19 to 25 bar at addition of 18% of secondary fluid.

What is claimed is:

1. An apparatus for increasing the pressure or the enthalpy of a fluid flowing at supersonic speed comprising, a first nozzle for acceleration of incoming vapor;

a converging second nozzle positioned downstream of the first nozzle and defining with the first nozzle a first slot therebetween for ingress of a primary liquid and subsequent mixture with the incoming vapor; and a diffuser positioned downstream of the second nozzle and defining with the second nozzle a second slot therebetween for ingress of a secondary liquid to thereby accelerate a condensation of the vapor in the mixture, wherein the second nozzle and the diffuser define together a parallel flow section which is breached by the second slot to define a flow section portion of the second nozzle and a flow section portion of the diffuser, wherein the second slot has a length extending in flow direction which is between 0.5 and 0.9 times a diameter of the flow section portion of the second nozzle; and wherein the first nozzle is a Laval nozzle.

2. The apparatus according to claim 1, wherein the Laval nozzle has a convergent part at an opening angle of about 25° to 60°, and a divergent part at an opening angle of about 3° to 20°.

3. The apparatus according to claim 1, wherein the second nozzle has a convergent part at an angle of about 15° to 30°.

4. The apparatus of claim 1, wherein the flow section portion of the second nozzle has a length which is about 1 to 3 times the diameter of the flow section portion of the second nozzle.

5. The apparatus of claim 1, wherein the flow section portion of the diffuser has a length which is about 1 to 5 times the diameter of the flow section portion of the diffuser.

6. The apparatus according to claim 1, wherein the mixture flows at supersonic speed to thereby draw in the secondary liquid.

7. An apparatus for increasing the pressure or the enthalpy of a fluid flowing at supersonic speed comprising, a first nozzle for acceleration of incoming vapor;

a converging second nozzle positioned downstream of the first nozzle and defining with the first nozzle a first slot therebetween for ingress of a primary liquid and subsequent mixture with the incoming vapor; and a diffuser positioned downstream of the second nozzle and defining with the second nozzle a second slot therebetween for ingress of a secondary liquid to thereby accelerate a condensation of the vapor in the mixture, wherein the second nozzle and the diffuser define together a parallel flow section which is breached by the second slot to define a flow section portion of the second nozzle and a flow section portion of the diffuser, wherein the second slot has a length extending in flow direction, which is between 0.5 and 0.9 times a diameter of the flow section portion of the second nozzle; and wherein the diffuser has a divergent zone at an opening angle of about 15° to 45°.

8. The apparatus of claim 7, wherein the first nozzle is a Laval nozzle.

9. The apparatus of claim 8, wherein the Laval nozzle has a convergent part at an opening angle of about 25° to 60°, and a divergent part at an opening angle of about 3° to 60°.

10. The apparatus according to claim 7, wherein the second slot is configured for drawing in the secondary liquid into the mixture when the mixture flows at supersonic speed.

11. The apparatus of claim 7, wherein the second nozzle has a convergent part at an angle of about 15° to 30°.

12. The apparatus of claim 7, wherein the flow section portion of the second nozzle has a length which is about 1 to 3 times the diameter of the flow section portion of the second nozzle.

13. The apparatus of claim 7, wherein the flow section portion of the diffuser has a length which is about 1 to 5 times the diameter of the flow section portion of the diffuser.

* * * * *